US006179293B1

(12) United States Patent
Hedman

(10) Patent No.: US 6,179,293 B1
(45) **Date of Patent: *Jan. 30, 2001**

(54) COMBINATION POKER-LIKE AND BLACK JACK-LIKE WAGERING CARD

(76) Inventor: Michael Hedman, 7603 Grandview Rd., Sacramento, CA (US) 95829

( * ) Notice: Under 35 U.S.C. 154(b), the term of this patent shall be extended for 0 days.

This patent is subject to a terminal disclaimer.

(21) Appl. No.: 09/175,918

(22) Filed: Oct. 20, 1998

(51) Int. Cl.[7] ..... A63F 1/00
(52) U.S. Cl. ..... 273/292; 273/274
(58) Field of Search ..... 273/292, 274, 273/309; 463/12, 13

(56) References Cited

U.S. PATENT DOCUMENTS

| | | | |
|---|---|---|---|
| 4,836,553 | | 6/1989 | Suttle et al. . |
| 4,861,041 | | 8/1989 | Jones et al. . |
| 5,265,882 | | 11/1993 | Malek . |
| 5,322,295 | | 6/1994 | Cabot et al. . |
| 5,328,189 | | 7/1994 | Malek . |
| 5,395,120 | | 3/1995 | Malek . |
| 5,411,268 | * | 5/1995 | Nelon et al. . |
| 5,417,430 | * | 5/1995 | Breeding . |
| 5,486,005 | | 1/1996 | Neal . |
| 5,678,821 | | 10/1997 | Hedman . |
| 5,697,614 | * | 12/1997 | Potter et al. . |
| 5,863,041 | * | 1/1999 | Boylan et al. . |
| 5,873,571 | * | 2/1999 | Vaisman et al. . |
| 5,921,550 | * | 7/1999 | Awada . |

OTHER PUBLICATIONS

Editor's Note, WIN Magazine, pp. 39–40 and 70, Apr. 1992.
Advertising brochure from Commerce Casino, Commerce, CA, Wisted's California Blackjack, 1992.
Advertising brochure from Gaming Concepts, Inc., Long Beach, CA, Over/Under 13™ Blackjack, 1988.
Royal Calkins, Blackjack introduced at Table Mountain, The Fresno Bee, Tuesday, Nov. 10, 1992.

* cited by examiner

*Primary Examiner*—William M. Pierce
(74) *Attorney, Agent, or Firm*—James M. Ritchey

(57) ABSTRACT

A method and apparatus for playing a card game between a house and one or more players in which each player wagers three bets on the five card hand they will receive from the house. The house randomizes the cards and distributes the randomized cards into eight hands. The throw of a die establishes the house or dealer and each player in the game. Each player arranges their five cards into a high blackjack hand and a low blackjack hand, as does the house. Additionally, each hand is used to create a poker hand. by comparing each player's hand with each player's hand and with the house's or dealer's hand to determine winning poker hands, winning high blackjack hands, and winning low blackjack hands are compared to the house's or dealer's hand. Winnings are allocated from is each of the bets based on the comparison. An optional poker jackpot bet may be included.

4 Claims, 2 Drawing Sheets

COMBINATION POKER-LIKE AND BLACK JACK-LIKE WAGERING CARD

BACKGROUND OF THE INVENTION

1. Field of the Invention

A card game and apparatus are disclosed that have for each player a plurality of different hands and associated wagering or betting plans and strategies. More particularly, related is a card game and table apparatus that utilize a standard 52 card deck and incorporate elements of American stud poker, low ball poker, high ball poker, no peek poker, blackjack or "21", and an ancient Chinese game of poker. From their initially distribution of cards, each player and the house or dealer form three different hands (one hand is poker-like and the other two hands are blackjack-like). Up to four bets are linked to the outcome of each player's cards as compared with the result of the house or dealer's cards.

2. Description of the Background Art

The games of poker and blackjack or similar equivalents have existed for centuries. Specifically, U.S. Pat. No. 4,836,553 discloses a poker game in which five cards are dealt to each player and the dealer. Should the dealer not have an ace and a king or better each player wins, but if the dealer has an ace and a king or better then standard poker hands establish the winner between each player and the dealer. Betting is coupled into each possible winning scenario.

A cumulative jackpot is included and betters win either all or a portion of this jackpot by having a hand containing a predetermined arrangement of cards.

Malek has developed casino games presented in related U.S. Pat. Nos. 5,265,882; 5,328,189; and 5,395,120. The '882 game is a combination of blackjack, draw poker, and baccarat in which each player play at least two of the three games against the dealer and other players. In the '189 game blackjack and baccarat are combined and each player can play both games against the dealer and other player. For the '120 game, the games of modified draw poker and blackjack are mixed into a situation in which each player bets and plays against other players and the house dealer.

A method of playing a multiple hand card game is presented in U.S. Pat. No. 5,322,295. The game involves multiple bettings. As each bet or wager is made a portion of the hand is dealt.

The foregoing patents reflect the state of the art of which the applicant is aware and are tendered with the view toward discharging applicant's acknowledged duty of candor in disclosing information which may be pertinent in the examination of this application. It is respectfully submitted, however, that none of these patents teach or render obvious, singly or when considered in combination, applicant's claimed invention.

SUMMARY OF THE INVENTION

An object of the present invention is to furnish a method of playing a card game that presents several chances for each player to win from the cards received from the house or dealer.

Another object of the present invention is to provide a card game between a house or dealer and at least one player in which poker and blackjack hands exist for each player in combination with mandatory and optional wagering.

A further object of the present invention is to describe a card game between a house or dealer and at least one player in which each player has one poker hand, a low blackjack hand, and a high blackjack hand in which a mandatory bet is associated with each of the three hands and an optional poker jackpot bet is linked to the outcome of the poker hand.

Still another object of the present invention is to supply a card game between a house or dealer and at least one player in which the assignment of the dealer is based on a comparison between a randomly generated number and assigned numbers for each player location.

Yet a further object of the present invention is to produce a gaming apparatus utilized in playing a card game between a house or dealer and at least one player in which poker and blackjack hands exist for each player in combination with mandatory and optional wagering.

Disclosed is a card game and method of playing a card game that is played between a house or dealer and one to seven players or on an automated machine operated by the house. Every player in the game selects at least one of eight player positions at a card table. The players then wager a mandatory poker ante, a mandatory high blackjack bet, and a mandatory low blackjack bet. If a player has been selected "dealer" by a randomized selection or by player's turn to deal cards in clockwise or counter clockwise direction from last dealer, no high hand or low hand bet is required. The house, dealer, or automated machine randomizes cards within a deck of 52 cards and distributes the randomized cards in a face down manner for each player.

Usually, the roll of one die (preferably an eight sided die), or other means, produces a random number that is utilized to determine who is dealer on the table. The numbers one through eight are assigned to the player positions in, usually, a clockwise manner. Using the established random number, the assigned number is matched to the established random number to produce the dealer position. From this position on, the house or dealer places a first of the five card hands in a clockwise distribution process until all of the players' hands are distributed to the player positions. Extra randomized cards not found within any of the hands and any of the hands at the player positions not matched with a player are placed into a discard area.

Each player arranges two or three of their the five card hand into a high blackjack hand and places the high blackjack hand one card at a time face down, ending up with one mandatory card face down, with one or two cards face up into a high hand designated area at their position on the card table. The remainder of their the five card hand is arranged into a low blackjack hand and placed one card at a time face down, ending up with one mandatory card face down, with one or two cards face up into a low hand designated area at their position on the card table. Cards may be placed in either hand at any time.

The house or dealer turns its five card hand into a two or three card high blackjack hand and places the high blackjack hand one card at a time face down ending up with one mandatory card face down with one or two cards face up onto the high hand designated area at the house or dealer position on the card table. The remainder of the house's or dealer's five card hand is arranged into a low blackjack hand and placed one card at a time face down, ending up with one mandatory card face down with one or two cards face up, on the low hand designated area at the house or dealer position on the card table. Cards may be placed in either hand at any time.

A poker hand for the house or dealer is created out of its randomized cards and a poker hand is created for each player hand out of their randomized cards.

Each player's hand is compared with each player's hand to establish a winning poker hand. A winning high blackjack hand, and a winning low blackjack hand are compared with dealer's hand to establish winning hand.

Winnings are allocated from each of the mandatory bets based on the comparison. Further, a determination of winning poker hands is made of winnings from each of the players who bet the optional poker bets.

A game apparatus utilized in playing a card game between a house or dealer and one to seven players comprises: a playing surface; a house or dealer position inscribed on the playing surface; a plurality of player positions designated on the playing surface for presenting player hands; a plurality of first betting regions marked on the playing surface for placing mandatory first bets; a plurality of second betting regions marked on the playing surface for placing mandatory second bets; a plurality of third betting regions marked on the playing surface for placing mandatory third bets.

Usually each of the plurality of player positions comprises a first domain for placing cards selected to be within a low blackjack hand and a second domain for placing cards selected to be within a high blackjack hand. Also, usually each of the plurality of first betting regions is proximate the first domain for placing cards selected to be within a low blackjack hand and each of the plurality of second betting regions is proximate the second domain for placing cards selected to be within a high blackjack hand.

Other objects, advantages, and novel features of the present invention will become apparent from the detailed description that follows, when considered in conjunction with the associated drawings.

DESCRIPTION OF THE PREFERRED EMBODIMENT

Figure 1:
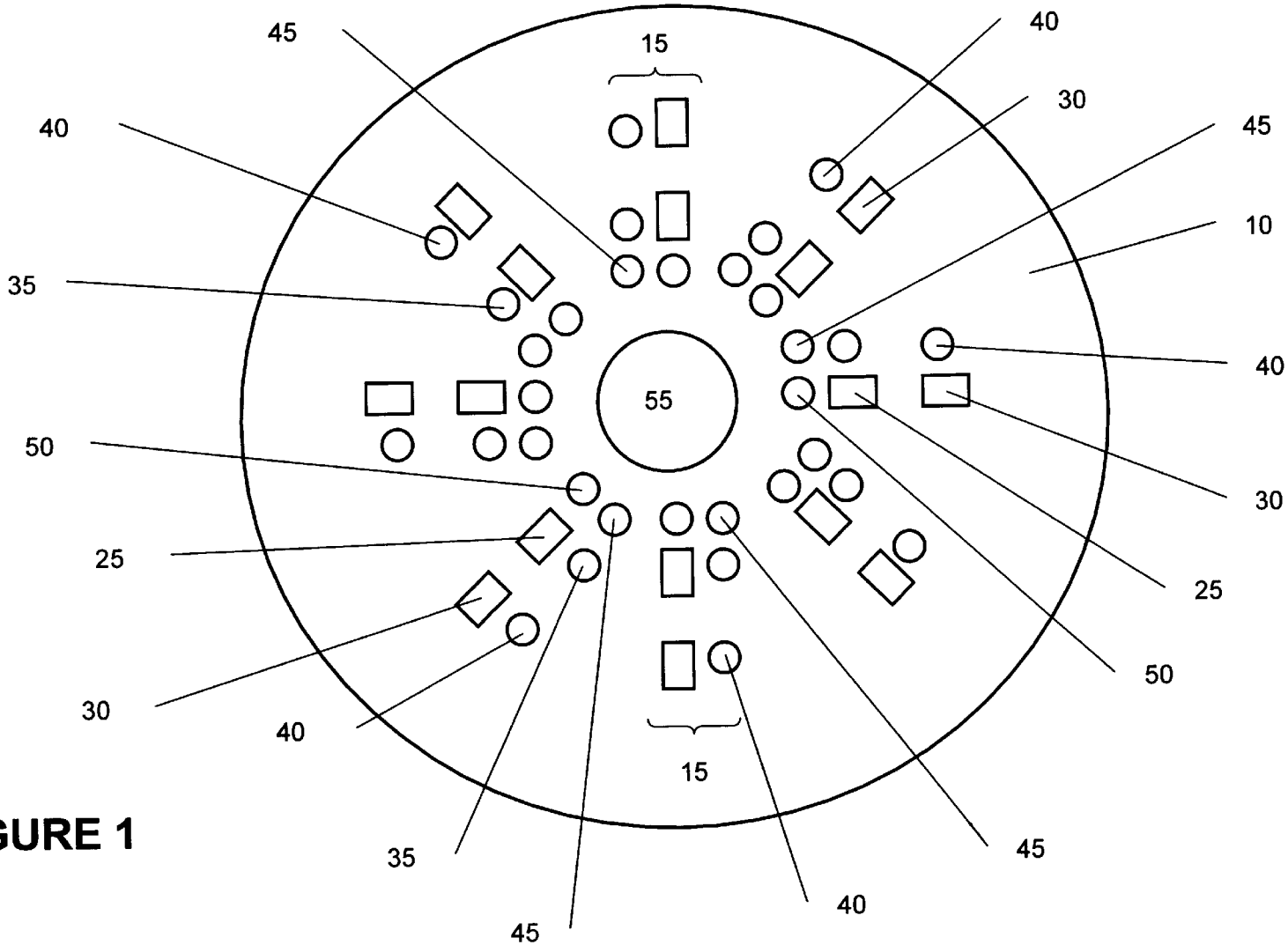
FIG. 1 is an overhead view of a board game showing the layout of hand and betting positions for the subject invention.
Figure 2:
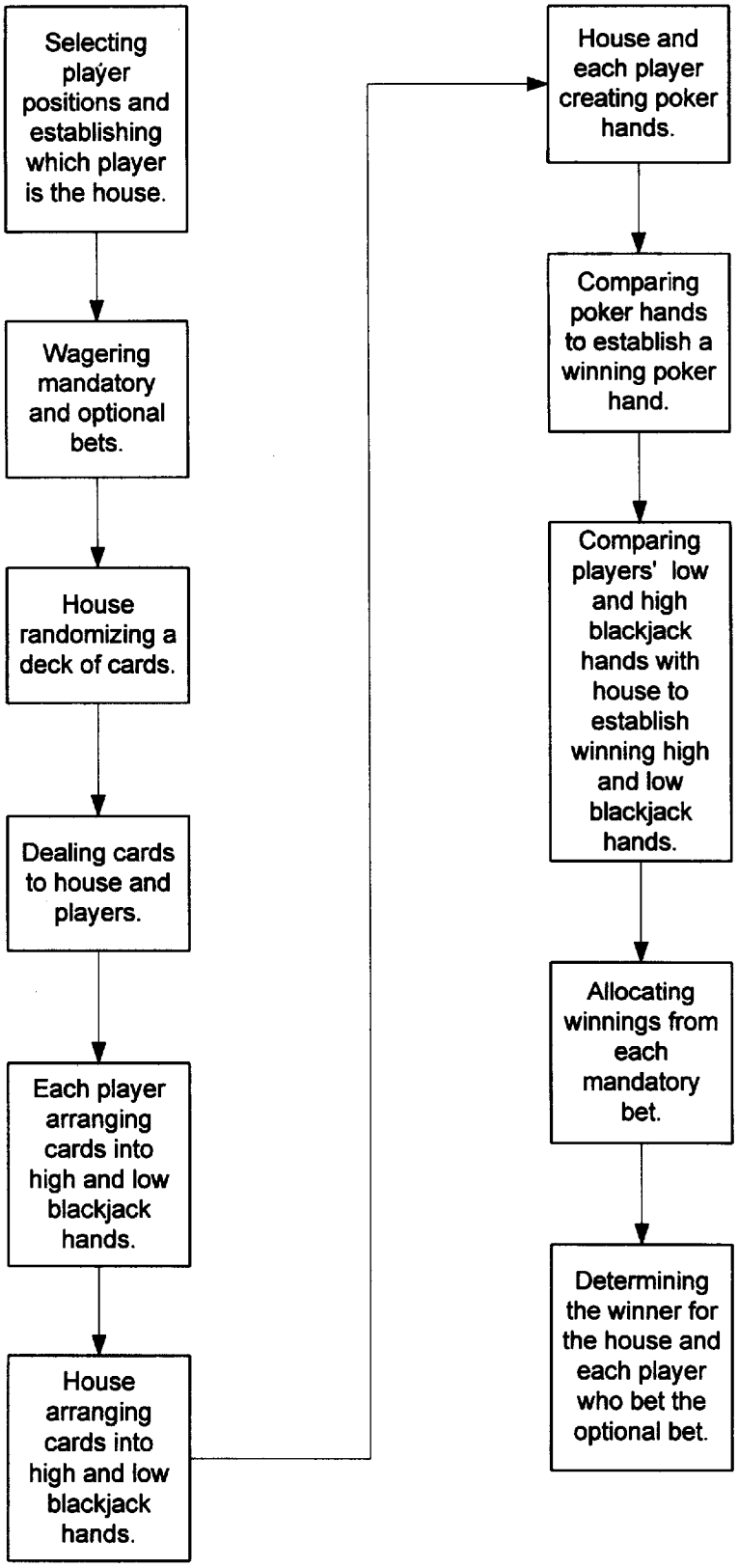
FIG. 2 is a flow chart illustrating the method steps for the subject invention

Referring now to FIGS. 1 and 2, there is shown a preferred embodiment of a board game layout and method of use of the subject invention. Comprising the subject invention is an apparatus and method of playing a card game between a house or dealer (for purposes of this specification and appended claims, the term house or dealer are equivalent and used interchangeably) and one or more players. The game is usually played between a house or dealer and one to seven players. Generally, the subject game comprises the steps of: each player wagering at least one bet and preferably three; the house or dealer randomizing cards within a deck of cards; the house or dealer distributing the randomized cards into a number of hands; the house or dealer and each player in the card game; each player arranging their randomized cards into a high blackjack hand and a low blackjack hand; the house or dealer setting its randomized cards into a high blackjack hand and a low blackjack hand; creating a poker hand for the house or dealer out of its randomized cards and a poker hand for each player out of their randomized cards; comparing each player's hand with each player's hand to establish a winning poker hand, comparing each player's hand with house or dealer's hand for a winning high blackjack hand, and a winning low blackjack hand; and allocating winnings from each bet based on the comparison.

More specifically, the subject card game employs the gaming or card table or covering shown in FIG. 1. A playing surface 10 is fabricated from suitable materials including natural and synthetic materials or coating such as felt, felt-like cloths, plastics, and the like. The playing surface 10 is usually patterned to conform to the shape of poker tables and the like or may be produced in any desired geometric configuration such as semicircular, circular, rectangular, and the like or with any suitable regular or irregular boundaries. The playing surface 10 may be placed on a game board for use at locations other than in a typical gambling casino. Symbols, writing, and the like are marked on the playing surface 10 by standard means such as printing, painting, drawing, and similar techniques.

Player positions 15 are denoted on the playing surface 10. The number of player positions 15 may vary between one and eight, however, preferably, the number of player positions 15 is eight, as shown in FIG. 1.

Usually, each player position 15 comprises a low blackjack designated area 25 and a high blackjack designated area 30. Additionally, three, usually mandatory betting regions are provided. Specifically, a first betting region 35 is marked proximate the low blackjack designated area 25, a second betting region 40 is marked proximate the high blackjack designated area 30, and a third betting region 45 is marked ante on the playing surface 10 in any suitable location, usually somewhere between the blackjack areas 25 and 30, although other locations are possible. Also, a fourth region 50, usually for a player's number, is marked on the playing surface 10. As with the third betting region 45, the player's number region 50 is marked on the playing surface 10 in any suitable location, usually somewhere above the blackjack areas 25 and 30, although other locations are possible.

The method by which the subject game is played is now described in terms of a preferred set of elements, however, those skilled in the art will appreciate that equivalent substitutions are also within the realm of the subject invention. Eight player positions are used as a preferred illustrative example and not by way of limitation, as are the exemplary minimum opening hands, winning hands, hands that are considered to be ties, and the like.

Object of the Game

The object of the card game of the subject invention is for any one of the players' poker hands to be higher than any one of the other player's poker hands, with the remaining two blackjack hands higher than the house's or dealer's blackjack hands. Preferably, each player's five card stud poker hand (other types of suitable poker are considered equivalent) needs to be higher valued. Equal value hands between player's and dealer in the poker hand is considered a tie for the player.

The player now splits the five cards into two blackjack hands. A low blackjack hand, of the players choice and containing two or three cards with one card face down, can be played to the value of 21. If the player's hand is greater than 21 the player "busts," thereby resulting in the loss of the wagered bet. A high blackjack hand, containing two or three cards depending on if three or two cards, respectively, are in the low hand, with one card face down, of the player's choice may be played to the value of 21. Each hand is played separately against the dealer's equivalent hand. For the blackjack hands, each hand consisting of the same value between the player and the dealer is considered a "push" or tie with no winner.

Play of the Game

The generalized steps for playing the subject card game are shown in FIG. 2. Generally, a dice cup containing one die is shaken by a selected player to determine who receives the dealer position. The first hand is defined as the hand dealt to the dealer's left within the array of hands. The numbers 1 through 8 assigned to the player positions 15 in a clockwise manner.

Each player and house or dealer then arranges the cards in their hand into a two or three card high blackjack hand and places one card in the high blackjack hand designated area or low blackjack hand designated area 35. This card can be placed face up or face down according to the player's strategy. After each player and house or dealer has placed one card down, the player with the highest valued card face up starts the betting for the poker hand. (Betting is optional depending on the type of poker game being played. After all betting is done, one more card is placed face up or face down in the high blackjack hand designated area 30 or the low blackjack hand designated area 25. The player or dealer with the highest valued card showing starts the betting. This is done for all the remaining cards. The end result is one card face down in the high blackjack hand designated area 30 with one or two cards face up. (Note: no more than three cards can be placed in either the high blackjack hand designated 30 area or the low blackjack hand designated area 25.) And one card face down in the low blackjack hand designated area 25 with one or two cards face up. The hand being better if it is closer to 21 in the standard manner should be placed in the high blackjack hand designated area 30. The remainder of the cards are placed in the low blackjack hand designated area 25.

Once all of the player cards and house or dealer's cards have been placed in the selected areas 25 and 30 and all betting for poker hand is finished the dealer turns the dealer's cards face up on the dealer's low and high blackjack hands. For consistency, house rules are applied to establish how the dealer forms the low and high hands. The house rules follow general blackjack procedures but are flexible and varied by individual house requirements.

To determine winning hands, each of the player's hands is then compared with the dealer's equivalent hand and each other player's hand. Player wagers that are lost are removed from the betting regions. A player wager that is a "push" is left on the in its betting region. Cards that are within a losing player hand, by virtue of being of lesser value than the dealer's equivalent hand or by going "busted" by exceeding 21, are removed and placed in the discard area or holder.

Generally, winning poker hands are paid according to the player or dealer with the highest poker hand (other types of suitable poker are considered equivalent). Although the payout may vary, usually, winning high and low blackjack hands pay even money. The winning poker hand is paid first, then all other payoffs are made according to bets made in bet circles.

Game Bets

Preferably, there are four different bets in the subject game. Usually and preferably, one of these bets is optional, but the other three bets are mandatory and are placed before the cards are dealt. The three mandatory bets are: a five card stud poker ante (placed in area 45 on the playing surface 10) that is played according to a predetermined amount set by players and house or dealer; a low blackjack hand wager (placed in area 35 on the playing surface 10) that pays according to standard blackjack odds (in most cases even odds); and a high blackjack hand wager (placed in area 40 on the playing surface 10) that is preferably exactly twice the amount of the low blackjack hand wager and pays according to standard blackjack odds (in most cases even odds). The optional fourth bet is a poker wager (placed in area 55 on the playing surface 10) that entitles the player to a chance at a poker jackpot payoff according to how good the player's hand is.

Poker Jackpot Wager

The player has the option to place a fourth bet or wager in the jackpot area 55 on the betting surface 10. If the player chooses to play this wager, it must be placed at the time all other players place theirs. Players may qualify for the poker jackpot by feeling they have the highest poker hand. This jackpot bet is paid to the player or house or dealer's hand who is higher. In the event two or more players tie for the poker jackpot in the same hand, the players share in the jackpot in a pro-rated system.

Additional Preferred Specific Rules of the Game

Various specific rules can be created by the house to facilitate operation of the subject game under diversified conditions or requirements. Listed below are eight rules that are usually and preferably applied to the subject game.

1. Players are not allowed to show their hands or talk to other players about their hands before all of the cards are exposed.

2. Any player who sets their hand incorrectly (e.g., the two or three card low blackjack hand ranks higher than the two or three card high blackjack hand or the player places more than three cards in their blackjack hand) is an automatic losing hand. Players are responsible for arranging their own hands.

3. For the stud poker hand, each player hand must be of higher value than the dealer's hand and all other player's hands equal value hands will be considered a tying hand.

4. All five cards must be played in form the low and high blackjack hands with a minimum of two cards and a maximum of three cards in both the low and high blackjack hands with one card face down in each group of cards.

5. Any high blackjack hand or low blackjack hand over 21 is considered a "busted" hand and automatically is a losing hand.

6. A two card blackjack (a combined card count total of 21 with out two cards) is a higher value hand than a three card 21 hand.

7. Numbered cards have their associated number value, face cards count ten, and aces are counted as one or eleven.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. A method of playing a card game between a house and one to seven players, comprising the steps of:

a) each player selecting a position at a card table;

b) establishing a random number and utilizing said random number to determine which of said players is the house and placed at a house position and which are placed at player positions;

c) each player and house wagering a mandatory poker ante bet, players only wagering a mandatory high blackjack bet and a mandatory low blackjack bet, and wagering an optional poker fourth bet by all players and house after each card is placed in a selected area;

d) the house randomizing cards within a deck of 52 cards;

e) the house distributing said randomized cards in a face down manner into two to eight five card hands, one of said hands for the house and one of said hands for each of said players;

f) placing extra said randomized cards not found within any of said hands into a discard area;

g) each player arranging two or three of their five card hand into a high blackjack hand or low blackjack hand and placing said cards one at a time with one card face down into a high hand designated area and one card face down into a low hand designated area at their said player position on said card table;

h) the house turning its said five card hand and setting its said five card hand into a two or three card high blackjack hand or low blackjack hand, one card at a time, and placing one card face down on said high blackjack hand and one or two cards face up into a high hand designated area at said house position on said card table and the remainder of its said five card hand into a low blackjack hand and placing one card face down said low blackjack hand and one or two cards face up into a low hand designated area at said house position on said card table;

i) creating a poker hand for the house out of its said randomized cards and a poker hand for each player out of their said randomized cards;

j) comparing each player's hand with the house's hand and all other players to establish a winning poker hand and comparing each player's hand with the house's hand to establish a winning high blackjack hand and a winning low blackjack hand;

k) allocating winnings from each of said mandatory bets based on said comparison; and l) determining for each said player and the house who bet said optional fourth bet, if said player or the house wins said optional fourth bet based on a winning poker hand.

2. A method of playing a card game according to claim 1, wherein said random number hand placement step further comprises the steps of:

a) assigning numbers 1 through 8 to said player positions in a clockwise manner;

b) using said established random number and matching to said assigned number to produce said house position for the house; and c) placing a first card of said five card hands at said first hand position clockwise from said house position and continuing placing said cards in a clockwise distribution process until all eight said hands are distributed at said house position and said player positions.

3. A method of playing a card game according to claim 1, wherein said optional fourth bet is a poker jackpot bet that is paid based on player and house participation.

4. A method of playing a card game according to claim 1, wherein said optional fourth bet is paid to highest poker hand.

* * * * *